US006722306B1

(12) United States Patent
Wang

(10) Patent No.: US 6,722,306 B1
(45) Date of Patent: Apr. 20, 2004

(54) AIR PUMP HAVING MINIMUM NUMBER OF PARTS

(75) Inventor: Kenneth Wang, Taipei (TW)

(73) Assignee: Team Worldwide Corporation, Taipei (TW)

( * ) Notice: Subject to any disclaimer, the term of this patent is extended or adjusted under 35 U.S.C. 154(b) by 0 days.

(21) Appl. No.: 09/492,831

(22) Filed: Jan. 27, 2000

(51) Int. Cl.[7] ..... B63B 7/08
(52) U.S. Cl. ..... 114/345; 5/708; 441/40
(58) Field of Search ..... 5/708; 114/345; 417/61, 313, 472, 474, 480, 478, 479, 442; 441/91, 40, 41

(56) References Cited

U.S. PATENT DOCUMENTS

| | | | | | |
|---|---|---|---|---|---|
| 388,037 | A | * | 8/1888 | Hargin | |
| 2,866,834 | A | * | 12/1958 | Gilbertson | 585/15 |
| 3,068,494 | A | * | 12/1962 | Pinkwater | 441/41 |
| 3,133,696 | A | * | 5/1964 | Mirando | 5/708 |
| 3,155,991 | A | * | 11/1964 | Dunham | 5/708 |
| 3,179,963 | A | * | 4/1965 | Peterson | 441/115 |
| 6,004,116 | A | * | 12/1999 | Wang | 5/708 |
| 6,287,095 | B1 | * | 9/2001 | Saputo et al. | 417/472 |

FOREIGN PATENT DOCUMENTS

| | | | | |
|---|---|---|---|---|
| DE | 807010 | * | 6/1951 | 5/708 |
| GB | 708759 | * | 5/1954 | 5/708 |
| WO | WO 96/02168 | * | 2/1996 | |

* cited by examiner

*Primary Examiner*—Sherman Basinger
(74) *Attorney, Agent, or Firm*—Quintero Law Office

(57) ABSTRACT

An air pump having a minimum number of parts. The air pump is built in the inflatable body of an inflatable product. The air pump consists essentially of a pump body, an air inlet provided on the pump body for introducing air outside the inflatable body into the pump body, and an air outlet also provided on the pump body for introducing the air from the pump body into the inflatable body.

28 Claims, 16 Drawing Sheets

AIR PUMP HAVING MINIMUM NUMBER OF PARTS

BACKGROUND OF THE INVENTION

1. Field of the Invention

The present invention relates in general to an air pump having a minimum number of parts.

2. Description of the Related Art

Referring to FIG. 1, an air mattress 12 has an inflation valve 16. The user uses an electric dryer 14 to inflate the air mattress 12 through the inflation valve 16. However, the user cannot fill up the air mattress very completely by using the electric dryer, because electric dryers available in the market for inflating an inflatable toy generally are cheap and the air pressure generated by the electric dryer is not high. Using the electric dryer to inflate the air mattress is acceptable. However, using the electric dryer to inflate an inflatable boat is not.

The user uses an air pump instead of an electric dryer to inflate an inflatable boat. Referring to FIGS. 2A and 2B, an inflatable boat 20 has a built-in air pump 25. The air pump 25 has a pump body 250, a band 251 and a heavy weight 256, wherein the heavy weight 256 is firmly attached to the bottom of the pump body 250. When the user pulls up the band 251, the heavy weight 256 resists the pull so that the pump body 250 is extended and outside air 200 is sucked into the pump body 250 through a check valve 253. Then, the user depresses the air pump, forcing the air 100 from the pump body 250 into the inflatable boat 20 through another check valve 254. The inflatable boat 20 can be filled with air by repeating such operations.

The present invention provides a modified air pump for filling up an inflatable product like an inflatable boat. The air pump has a minimum number of parts to reduce the material and production cost thereof.

SUMMARY OF THE INVENTION

An object of the present invention is to provide a simplified, low-cost air pump. The air pump of the present invention is built in the inflatable body of an inflatable product. The air pump consists essentially of a pump body, an air inlet provided on the pump body for introducing air outside the inflatable body into the pump body, and an air outlet also provided on the pump body for introducing the air from the pump body into the inflatable body.

It is noted that the pulling band of the prior art for the user to restore the air pump shape is not used in the present invention. The air pump of the present invention only has three parts—the pump body, the air inlet and the air outlet.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Figure 3:
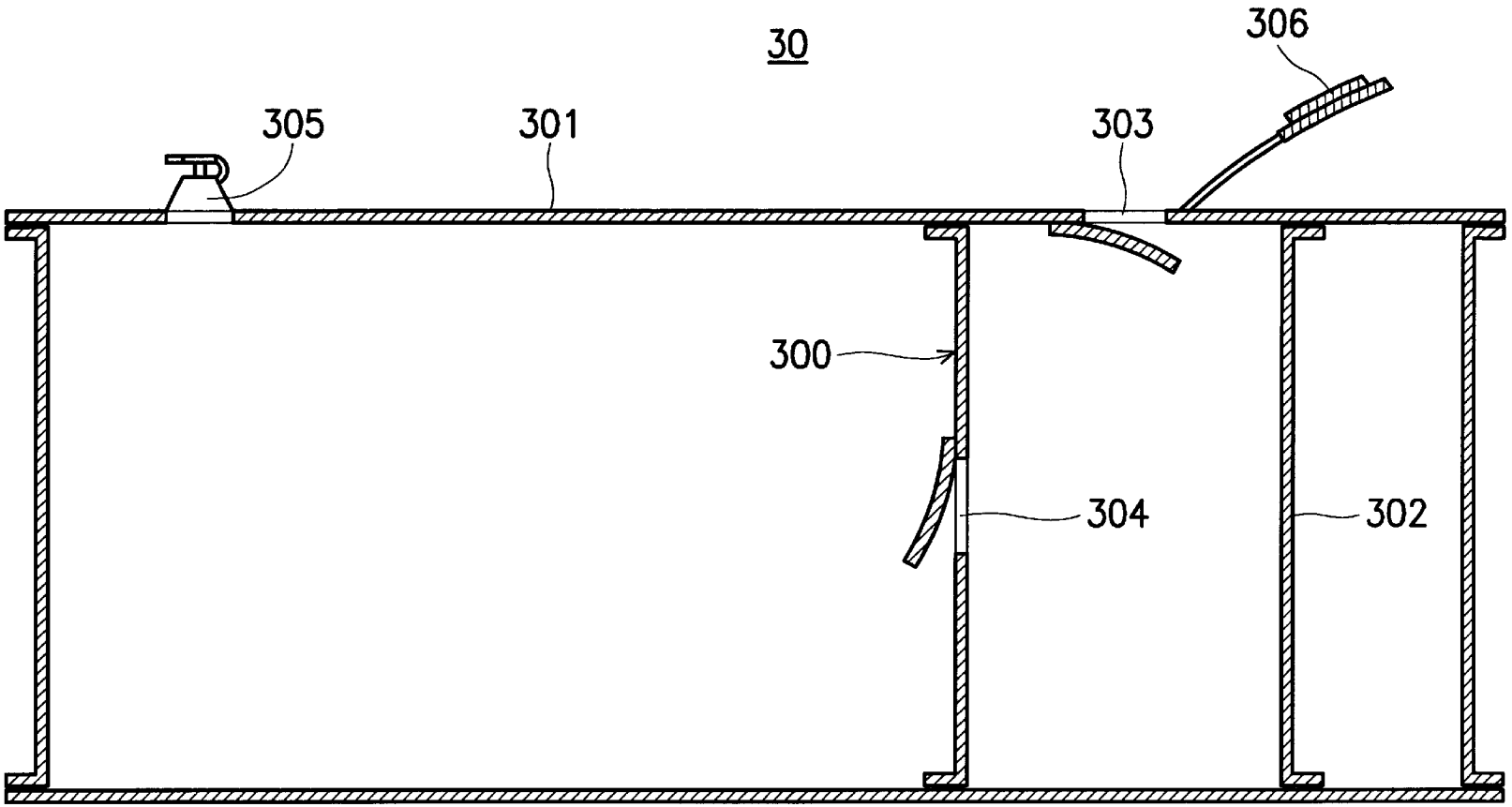
FIG. 3 is a sectional diagram of an inflatable product in accordance with a first embodiment of the present invention.
Figure 4A:
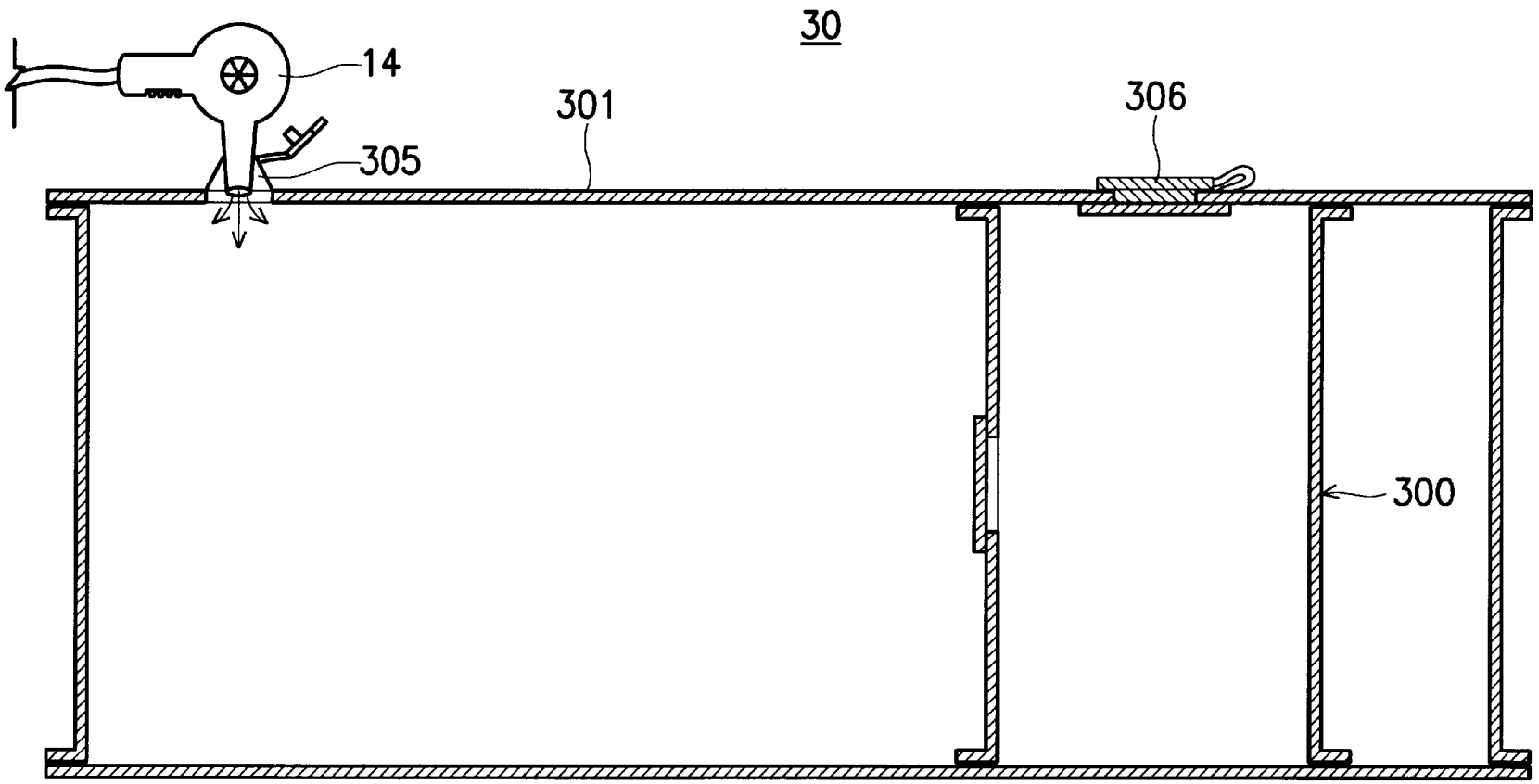
FIGS. 4A–4D show the steps of filling up the inflatable product of the first embodiment.
Figure 4B:
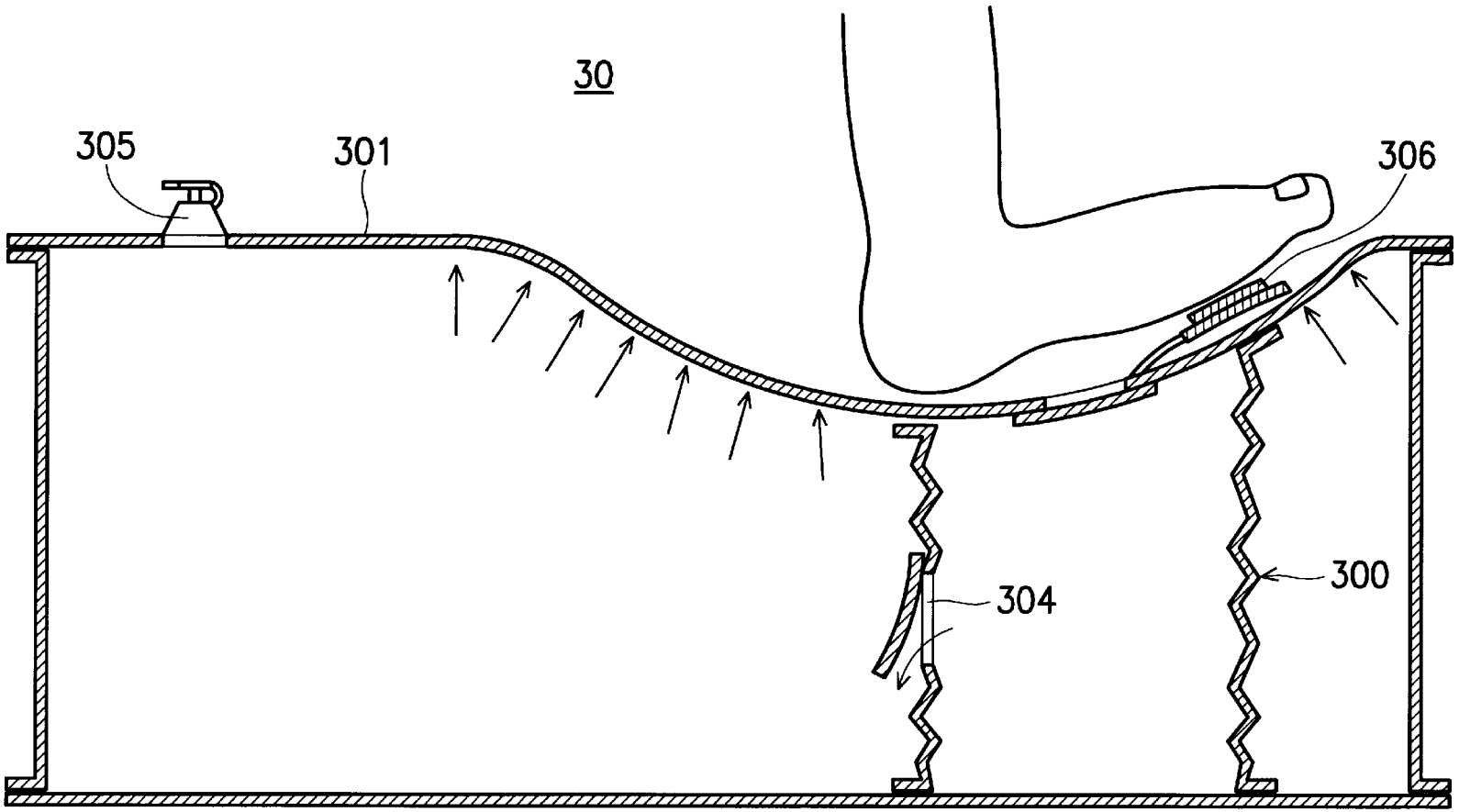
Figure 4C:
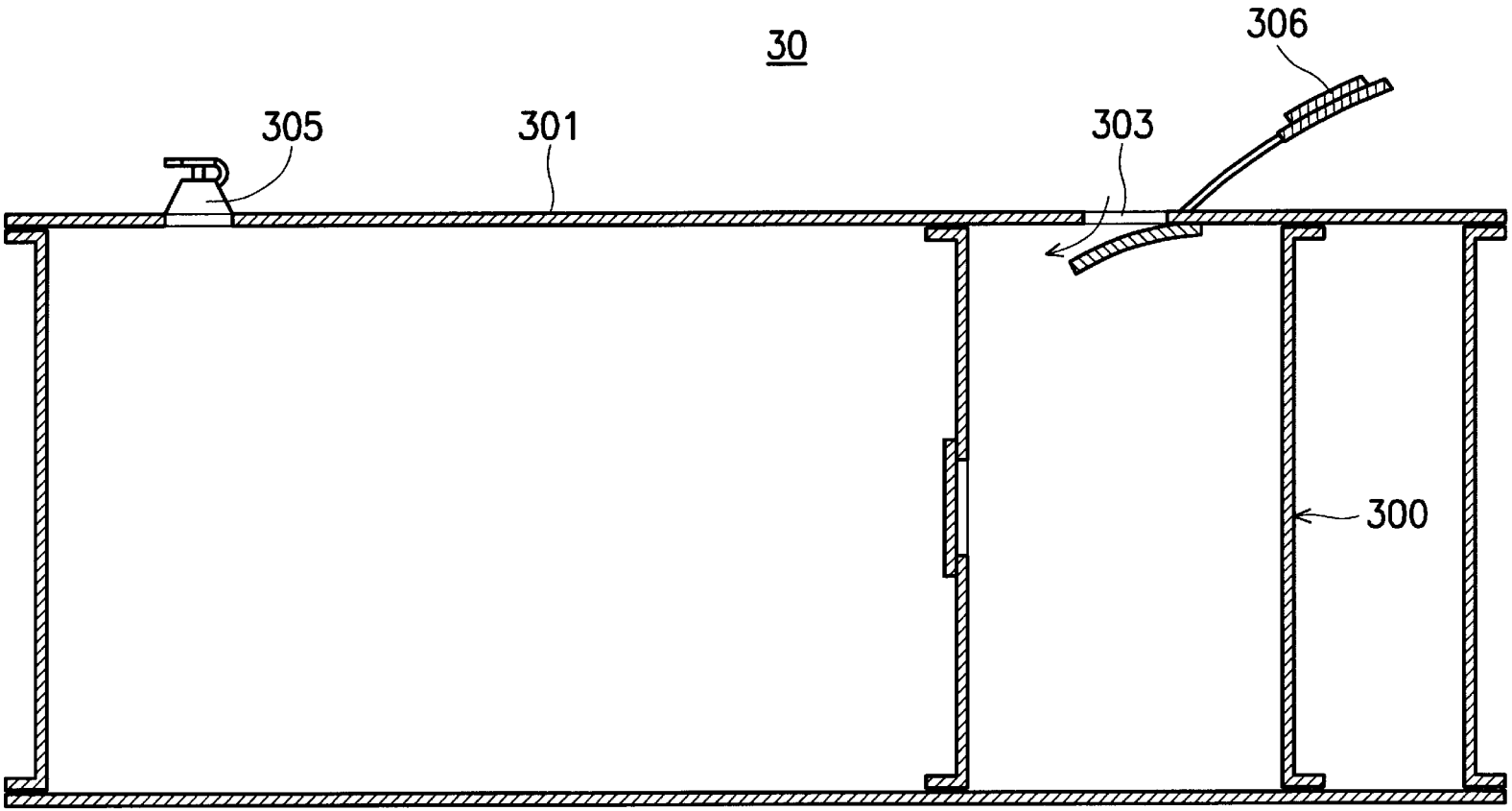
Figure 4D:
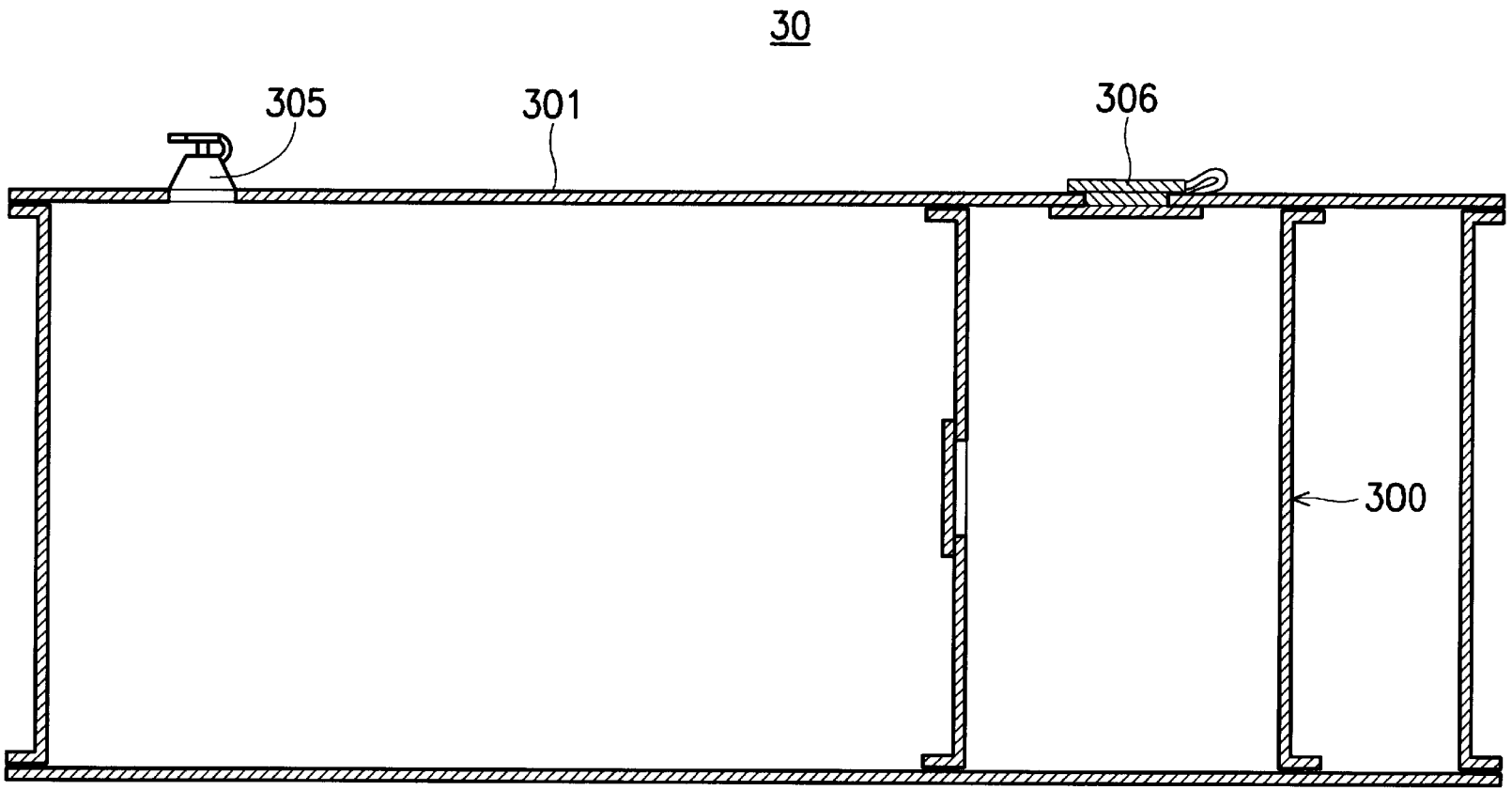

Referring to FIG. 3, an inflatable product 30 of a first embodiment of the present invention includes an inflatable body 301 and an air pump 300 built in the inflatable body 301. The air pump 300 has a pump body 302, an air inlet 303 for introducing outside air into the pump body 302, an air outlet 304 for introducing the air from the pump-body 302 into the inflatable body 301 and a plug 306 provided besides the air inlet 303 for closing the air inlet 303. Also, a deflation valve 305 is provided on the inflatable body 301 to deflate the inflatable product 30. FIGS. 4A–4D shows the steps of filling up the inflatable product: First, the user uses an electric dryer 14 to inflate the inflatable product 30 through the deflation valve 305 (FIG. 4A). The inflatable product 30 cannot be saturated because the air pressure generated by the electric dryer 14 is low. Then, the user pulls the plug 306 up and steps on the air pump 300, thereby pushing the air from the air pump into the inflatable body 301 through the air outlet 304 (FIG. 4B). Then, the user lifts up his foot. The air pressure in the inflatable body 301 restores the air pump shape. Meanwhile, outside air is sucked into the air pump 300 through the air inlet 303 (FIG. 4C). By repeatedly stepping on the air pump, the user fills up the inflatable product. Then, the user puts the plug 306 in the air inlet 303 to prevent the air inside the inflatable product from escaping (FIG. 4D).

Figure 1:
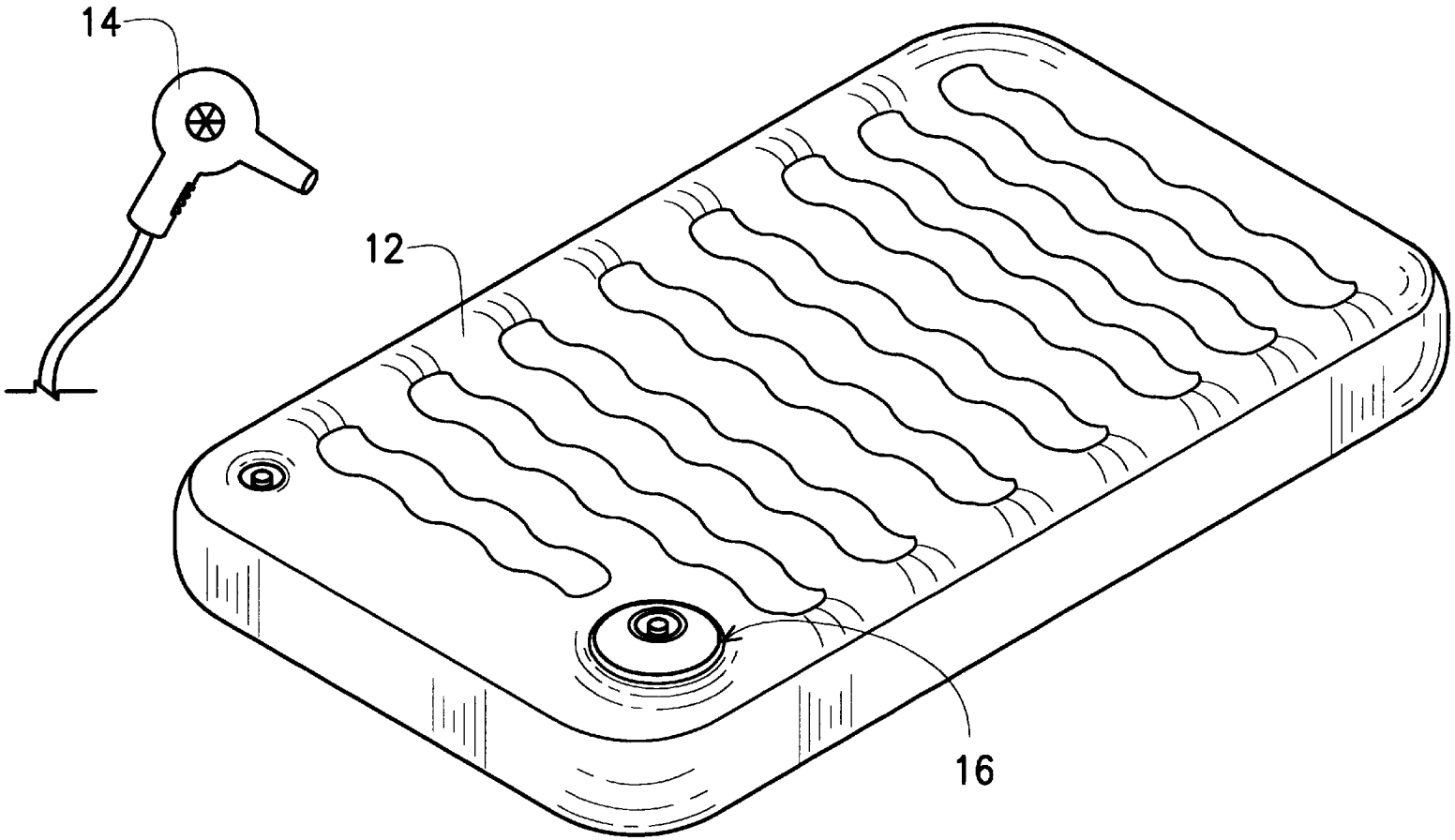
FIG. 1 (PRIOR ART)
FIG. 1 is a perspective diagram of an inflatable product in accordance with an example of the prior art.
Figure 2A:
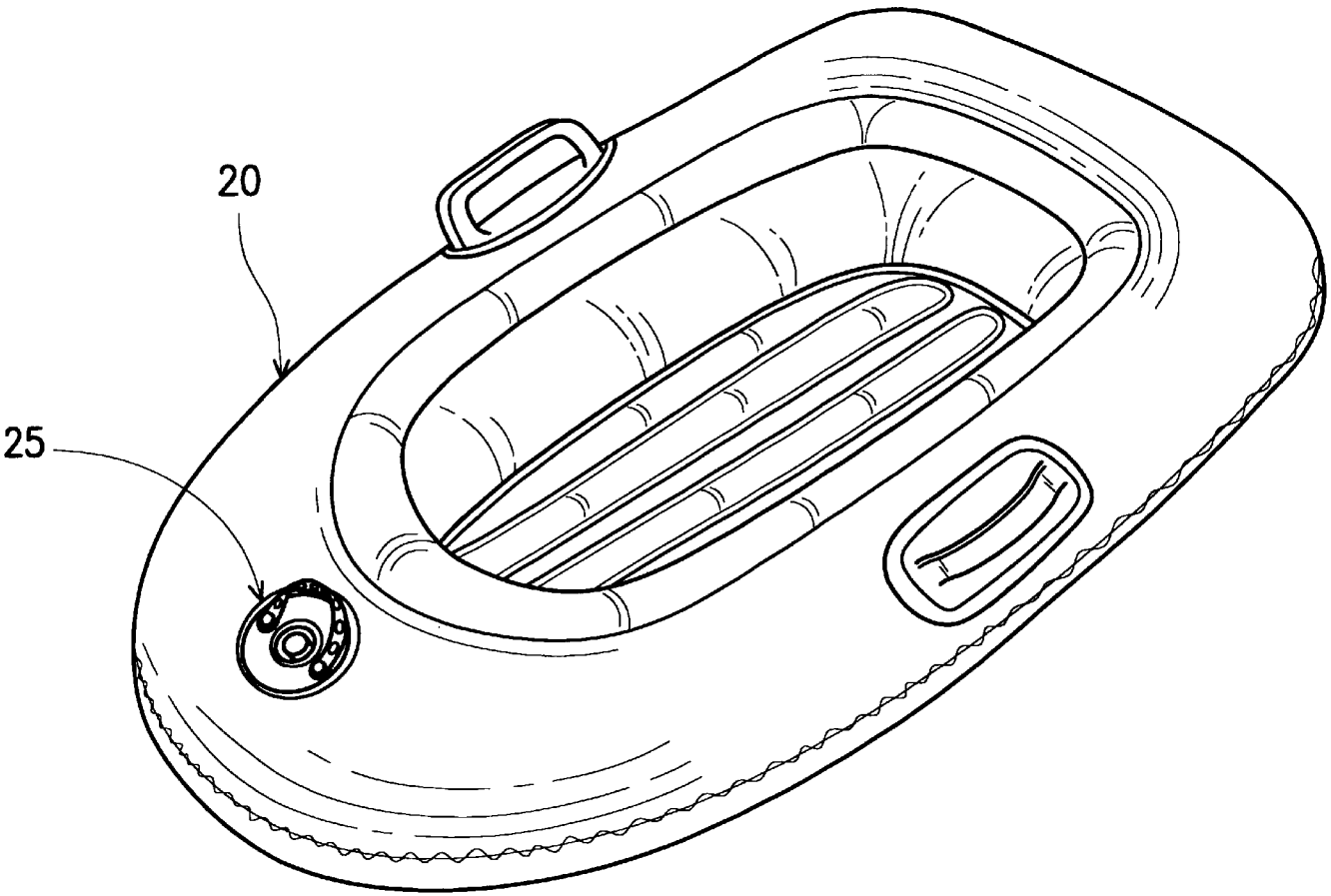
FIG. 2A (PRIOR ART)
FIG. 2A is a perspective diagram of an inflatable product in accordance with another example of the prior art.
Figure 2B:
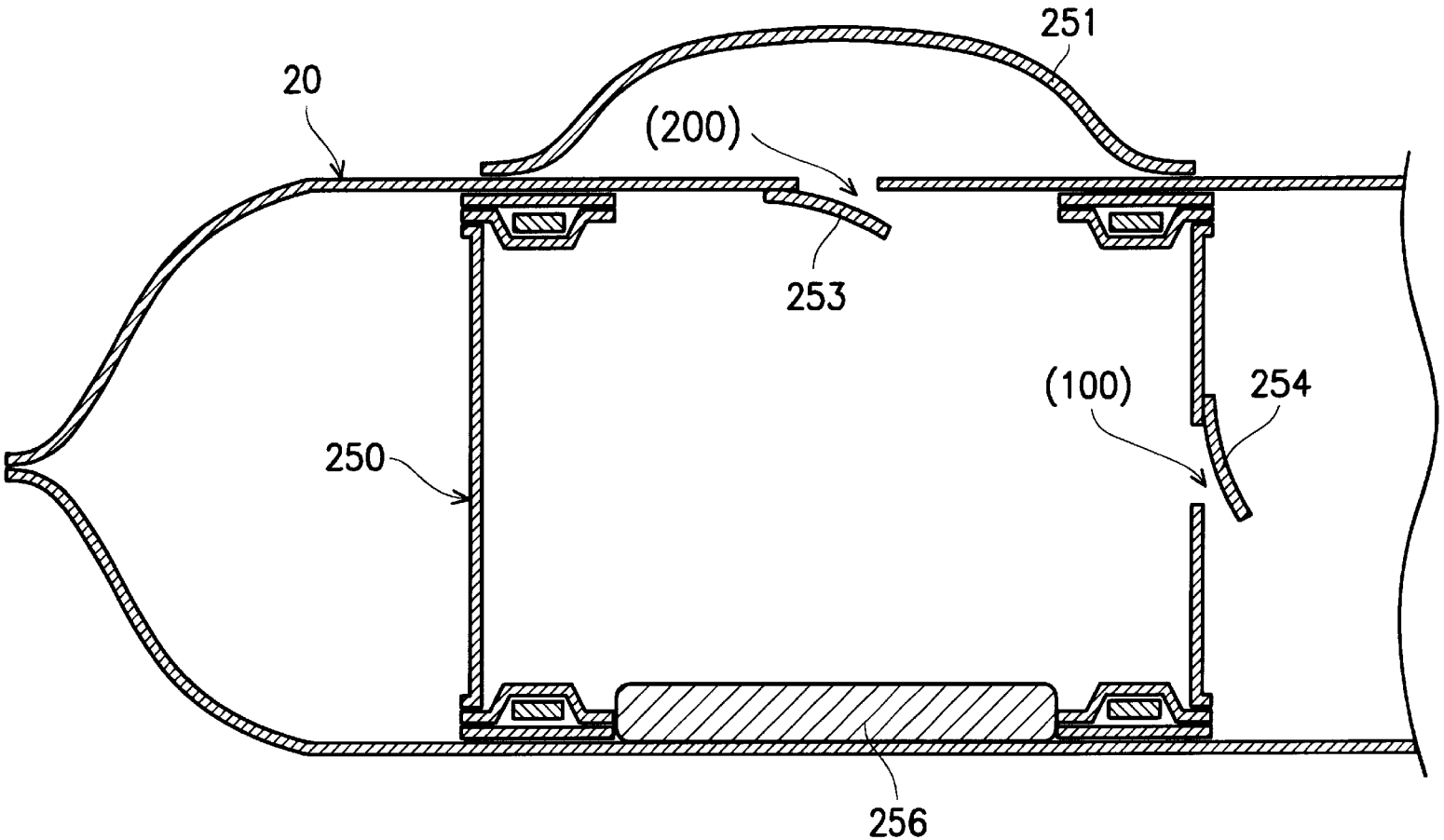
FIG. 2B (PRIOR ART)
FIG. 2B is a sectional diagram of FIG. 2A.

It is noted that the pulling band of the prior art indicated by reference number 251 in FIGS. 2A and 2B for the user to restore the air pump shape is not used in the present invention. Rather, the pressed air pump 300 of the present invention automatically extends by virtue of the air pressure in the inflatable boy 301. In conclusion, the air pump of the present invention has a minimum number of parts and is simpler than that of the prior art in structure.

Figure 5A:
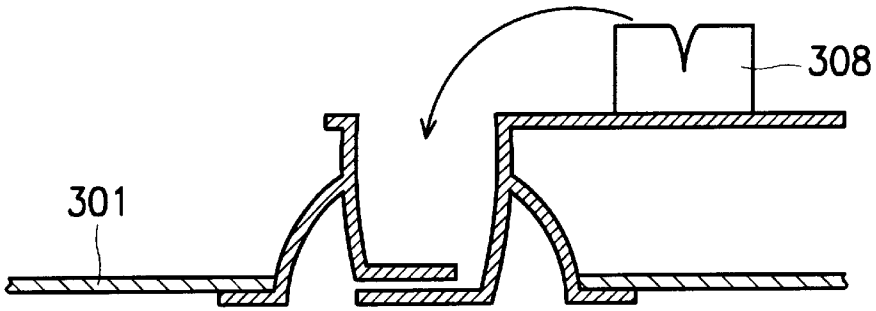
FIGS. 5A, 5B and 5C show different closing devices for closing the air inlet of the air pump of the present invention.
Figure 5C:
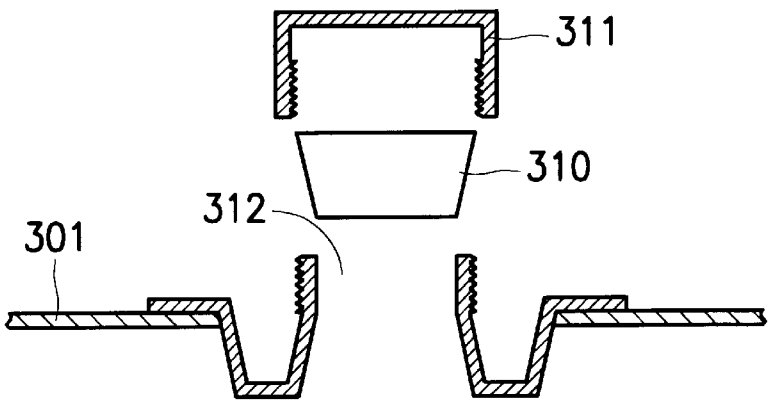
Figure 5B:
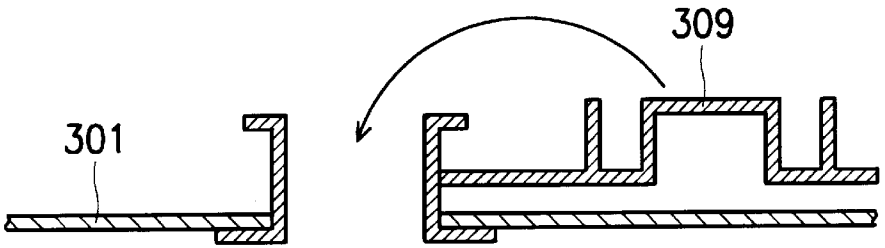

The plug 306 is used for completely closing the air inlet 303. FIGS. 5A, 5B and 5C show different closing devices functioning the same, in which reference numbers 308, 309, 310 indicate different types of plugs. In FIG. 5C, the plug 310 is fitted into the air inlet 312. Then, a threaded cap 311 is screwed to the air inlet 312.

Figure 6:
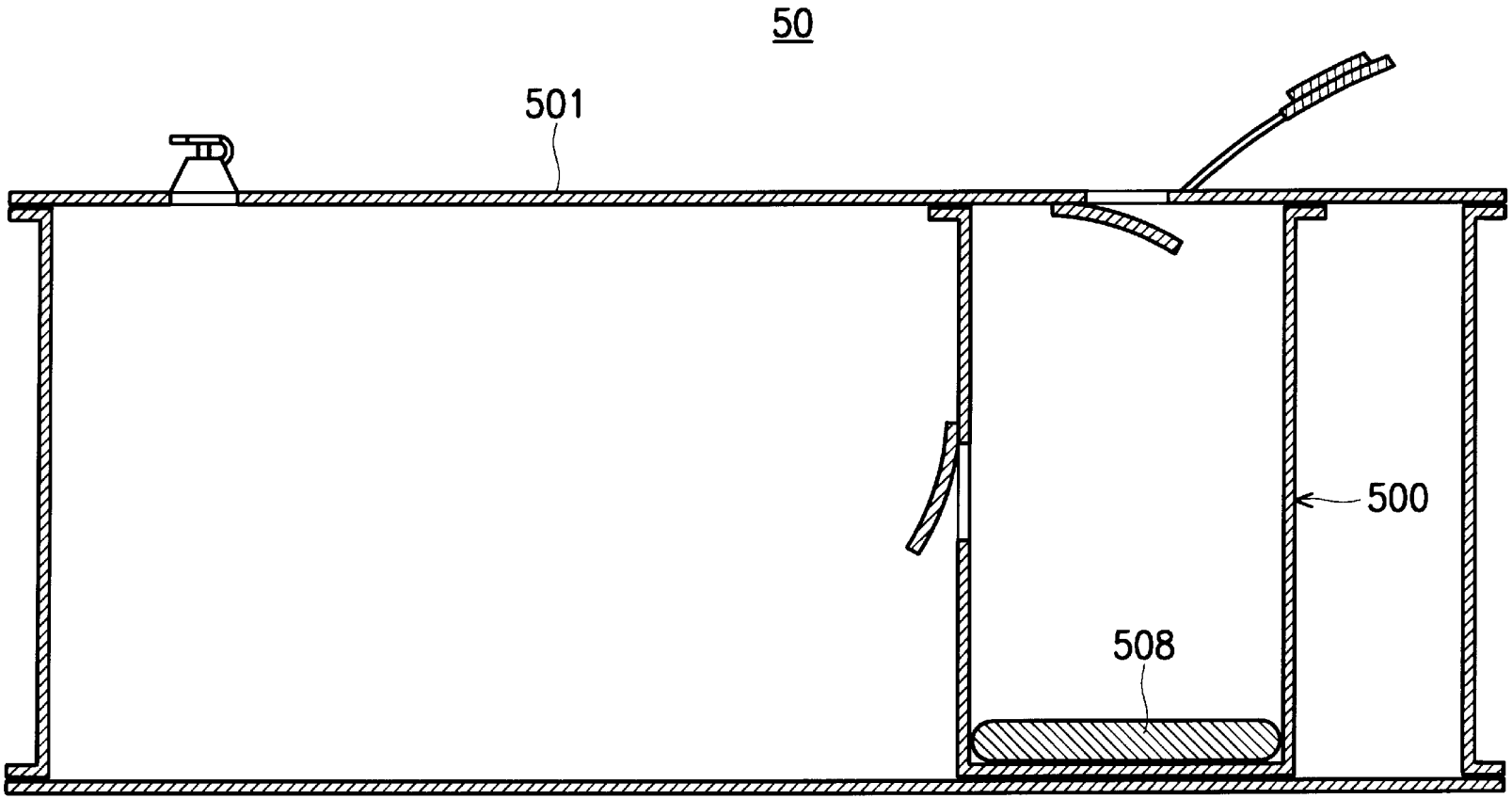
FIG. 6 is a sectional diagram of an inflatable product in accordance with a second embodiment of the present invention.

Referring to FIG. 6, an inflatable product 50 of a second embodiment of the present invention includes an inflatable body 501 and an air pump 500 built in the inflatable body 501. It is noted that the bottom of the air pump 500 is not attached to the inflatable body 501. A heavy weight 508 is attached to the bottom of the air pump 500 to facilitate the extension of the air pump when the air pressure in the inflatable body 501 restores the air pump shape. By repeatedly stepping on the air pump, the user fills up the inflatable product completely.

Figure 7:
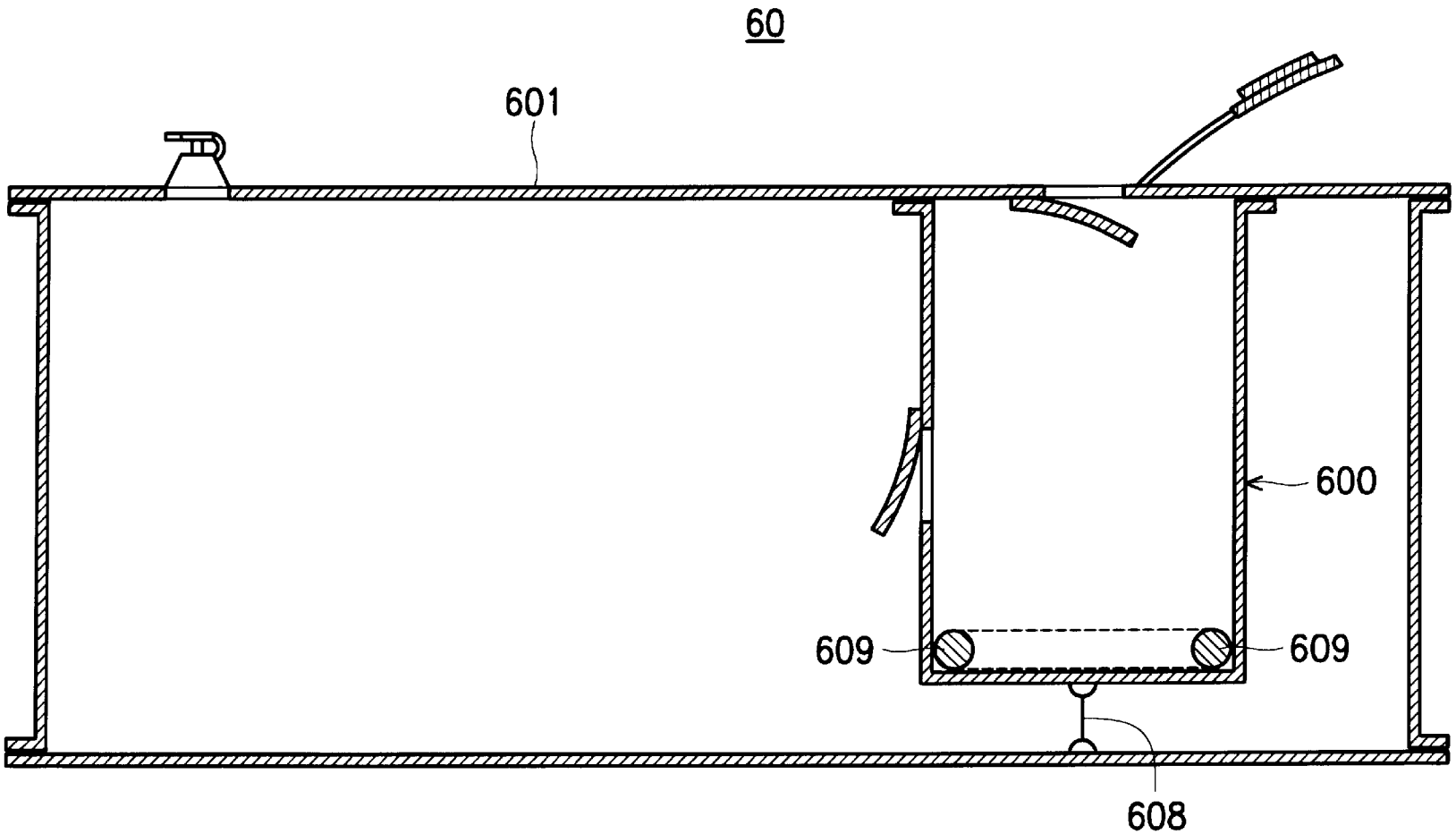
FIG. 7 is a sectional diagram of an inflatable product in accordance with a third embodiment of the present invention.

Referring to FIG. 7, an inflatable product 60 of a third embodiment of the present invent-ion includes an inflatable body 601 and an air pump 600 built in the inflatable body 601. A piece of string (or a band) 608 is connected between the inflatable body 601 and the bottom of the air pump 600 to facilitate an extension of the air pump. Also, a stiff ring 609 is attached to the bottom of the air pump 600 to prevent the air pump 600 from laterally contracting during the extension of the air pump 600.

Figure 8:
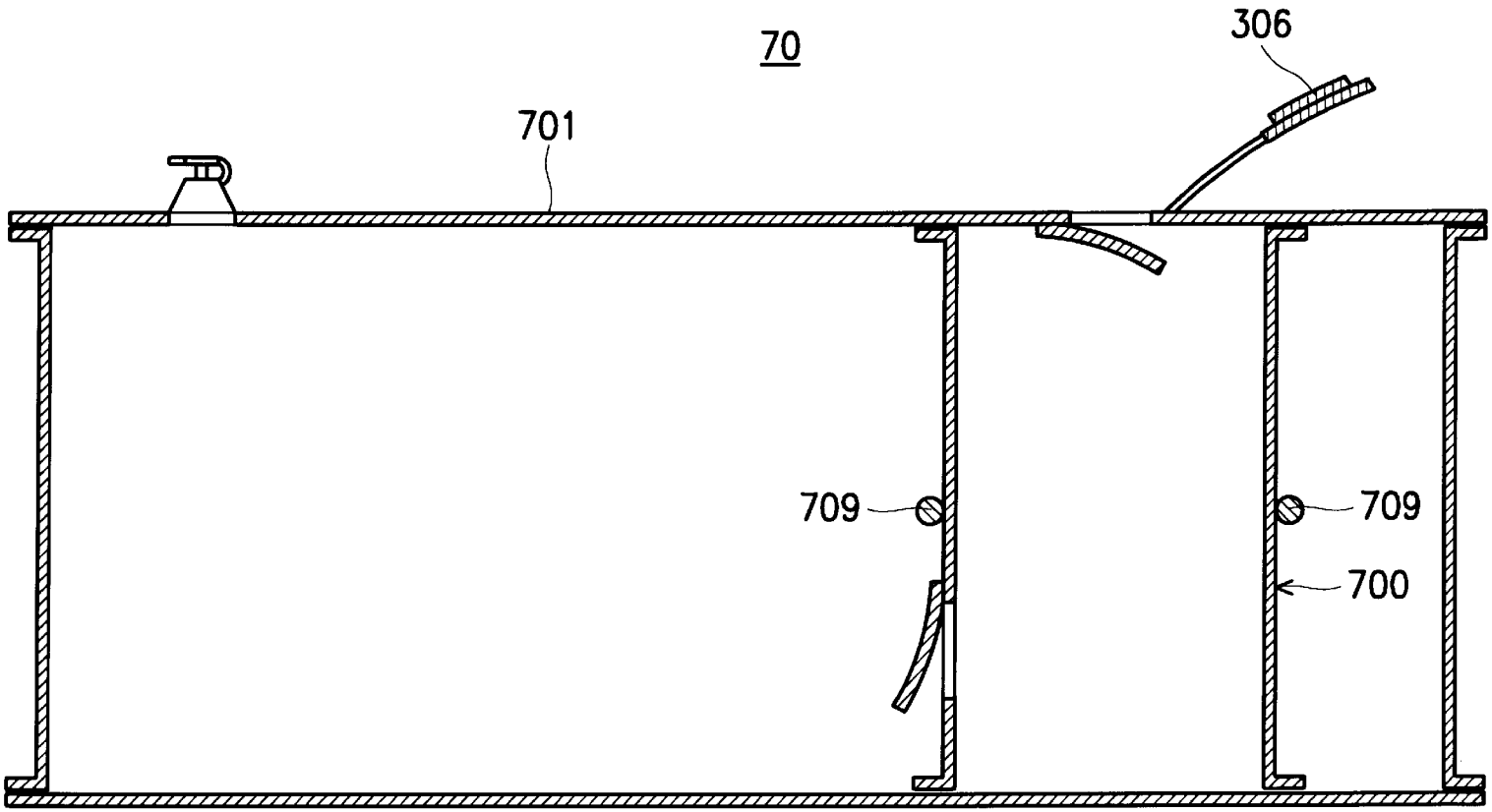
FIG. 8 is a sectional diagram of an inflatable product in accordance with a fourth embodiment of the present invention.

Referring to FIG. 8, an inflatable product 70 of a fourth embodiment of the present invention includes an inflatable body 701 and an air pump 700 built in the inflatable body 701. A stiff ring 709 is attached to the sides of the air pump 700 to prevent the air pump 700 from laterally contracting during the extension of the air pump 700.

Figure 9:
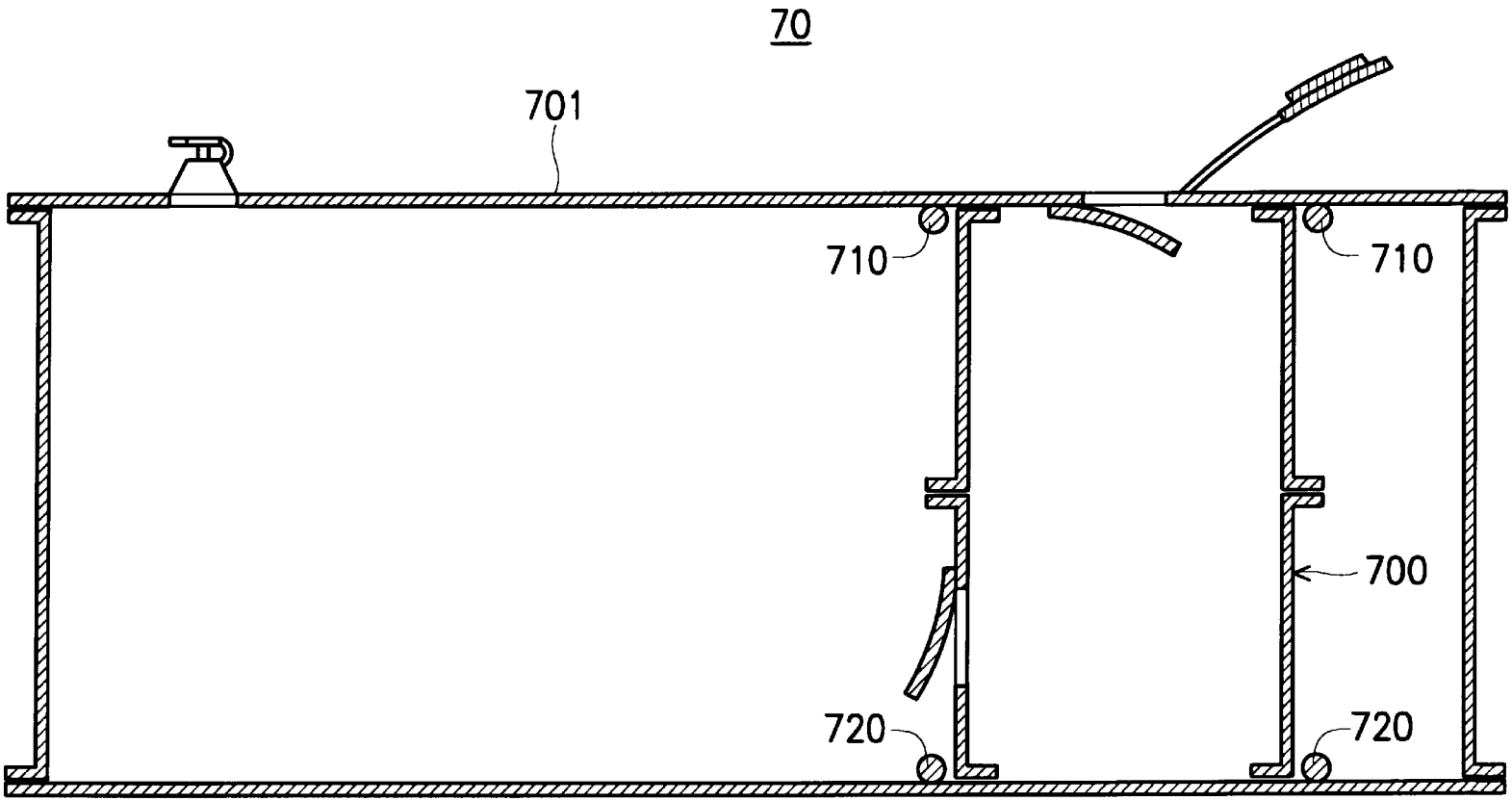
FIG. 9 is a sectional diagram of an inflatable product in accordance with a fifth embodiment of the present invention.

Referring to FIG. 9, in a fifth embodiment of the present invention, two stiff rings 710, 720 are attached to the top and bottom surfaces of the inflatable body 701 while the air pump 700 is enclosed by the rings 710, 720. This arrangement also prevents the air pump 700 from laterally contracting during the extension of the air pump 700.

Figure 10A:
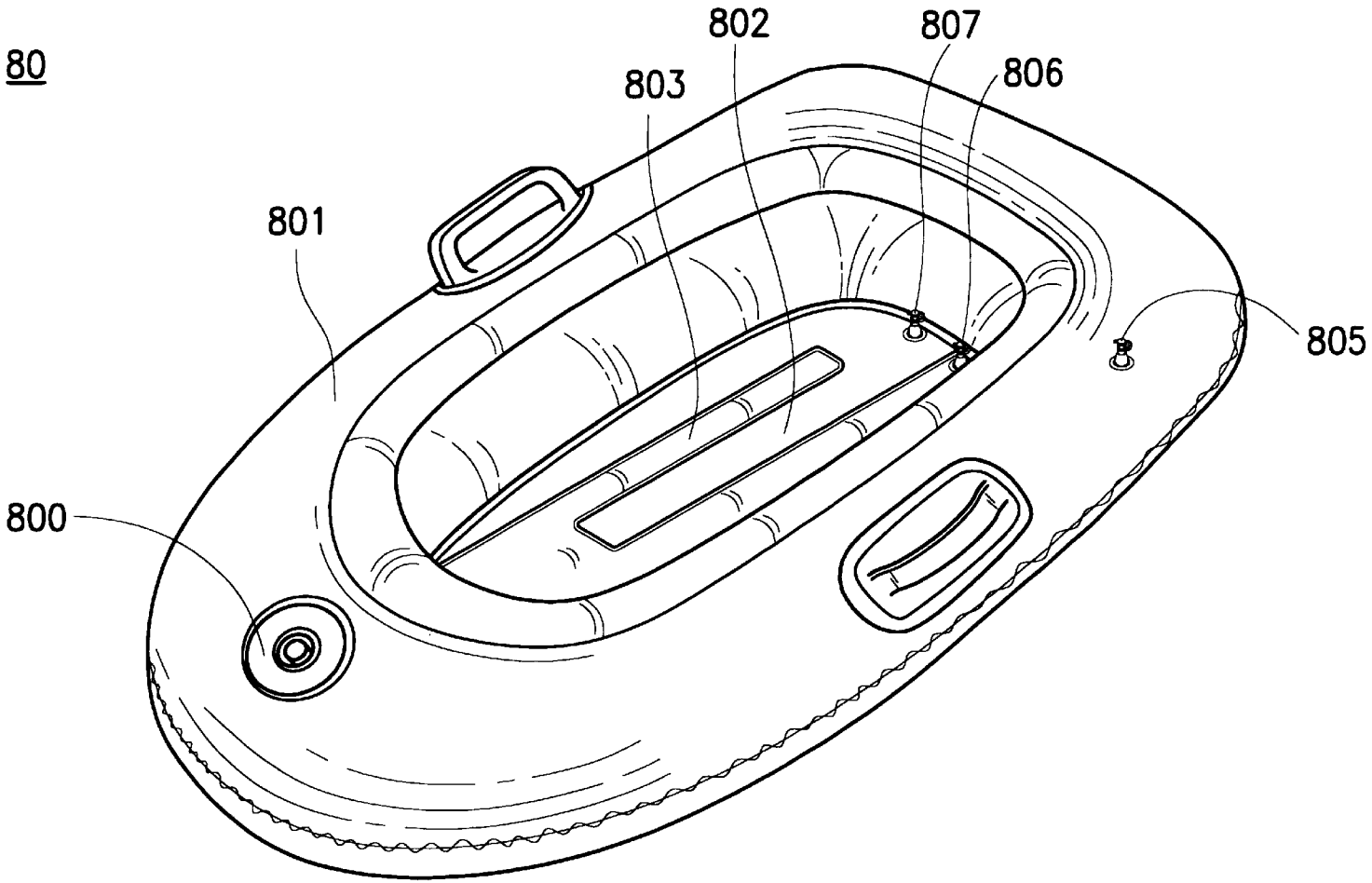
FIG. 10A is a perspective diagram of an inflatable product in accordance with a sixth embodiment of the present invention.
Figure 10B:
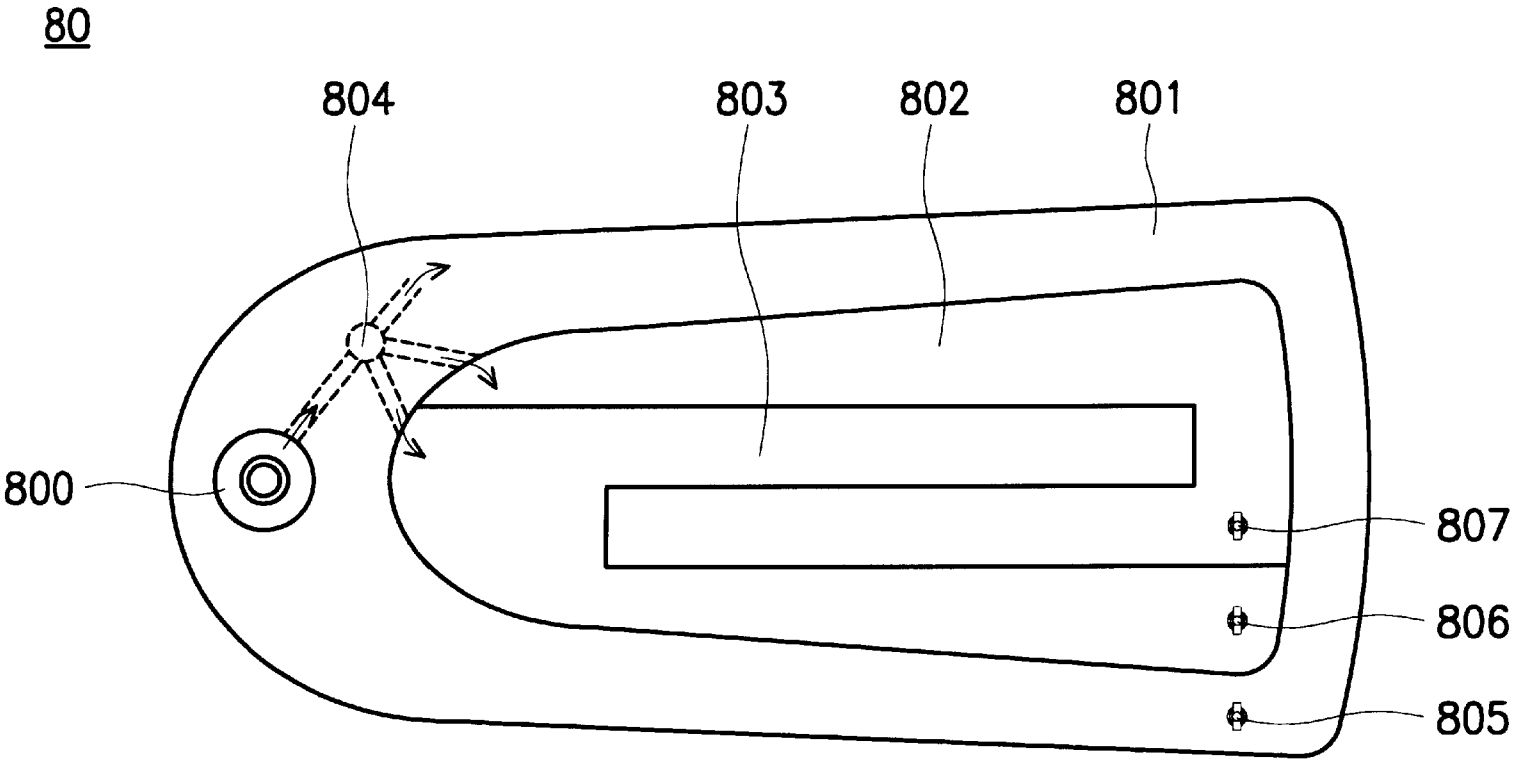
FIG. 10B is a top view of FIG. 10A.

Referring to FIGS. 10A and 10B, the inflatable product of a sixth embodiment of the present invention is a boat 80. The boat 80 has three air chambers 801, 802, 803 isolated from each other so that a hole or cracks formed by accident do not sink the boat. Furthermore, the inflatable boat 80 has an air pump 800 and a four-way valve 804 inside. The air pump 800 is the same as the air pump disclosed in the above-mentioned first, second, third or fourth embodiment. The four-way valve 804 connects the air pump 800 and the air chambers 801, 802, 803. In operation, the user uses an electric dryer to inflate the air chambers 801, 802, 803, respectively. Then, the user repeatedly steps on the air pump 800 to fill the air chambers 801, 802, 803 with air via the four-way valve 804.

Figure 11:
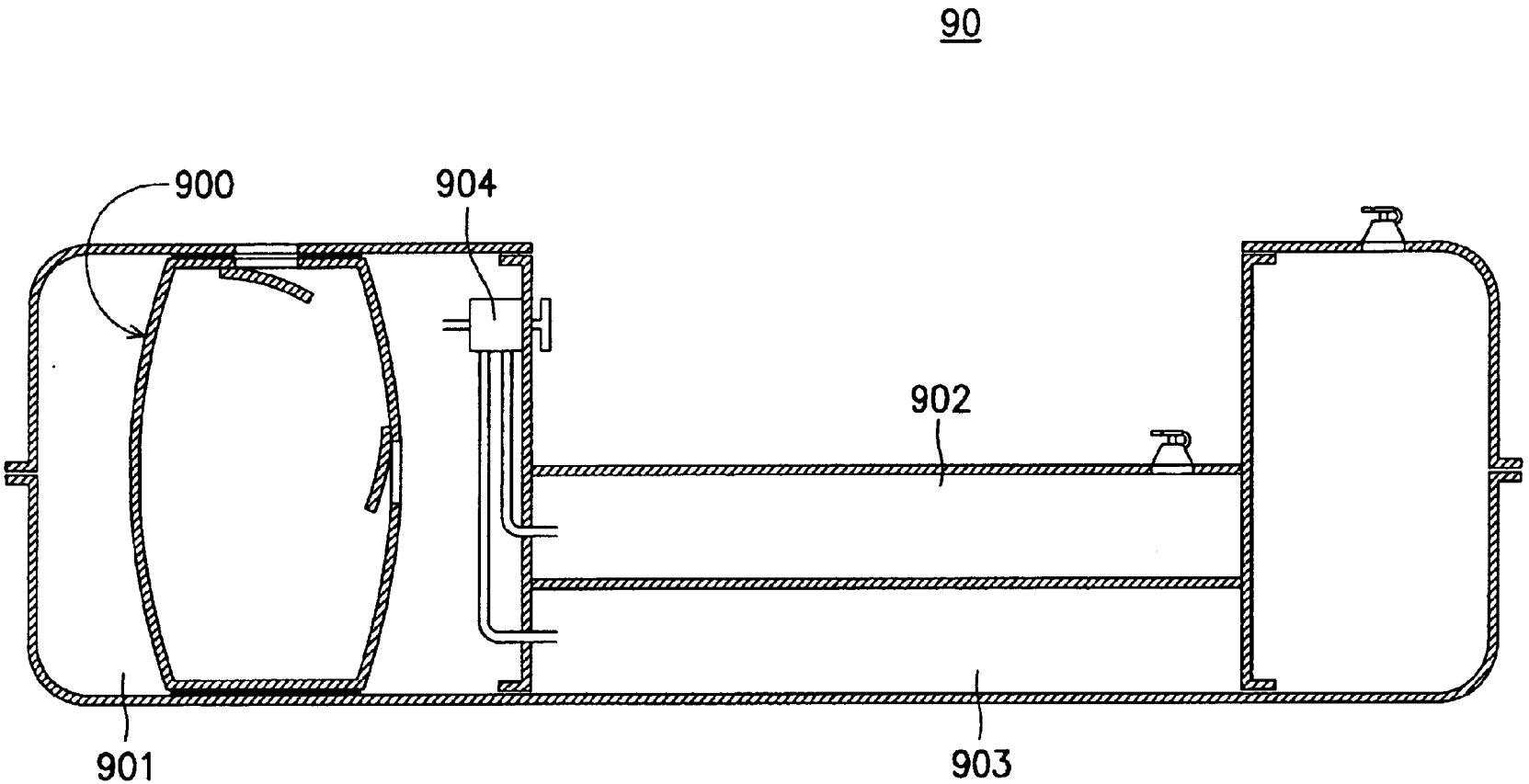
FIG. 11 is a sectional diagram of an inflatable product in accordance with a seventh embodiment of the present invention.

Referring to FIG. 11, a modified inflatable boat 90 of the sixth embodiment of the present invention has three air chambers 901, 902, 903, an air pump 900 and a three-way valve 904. The air pump 900 is built in the air chamber 901, while the three-way valve 904 connects the air chambers 901, 902, 903. It is noted that the three-way valve 904 is not directly connected to the air pump 900. Outside air is pumped into the air chamber 901 via the air pump 900. Then, the air in the air chamber 901 flows into other air chambers 902, 903 via the three-way valve 904.

In conclusion, the air pump of the present invention has a minimum number of parts and is simpler than that of the prior art in structure. The pulling band of the prior art indicated by reference number 251 in FIGS. 2A and 2B for the user to restore the air pump shape is not used in the present invention. Rather, the pressed air pump of the present invention automatically extends by virtue of the air pressure in the inflatable body.

While the invention has been described by way of example and in terms of the preferred embodiment, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An inflatable product, including:

an inflatable body having air pressure inside; and an air pump built in the inflatable body, the air pump consisting of a pump body, an air inlet provided on the pump body for introducing air outside the inflatable body into the pump body when the pump body is extended, and an air outlet also provided on the pump body for introducing the air from the pump body into the inflatable body when the pump body is compressed, wherein the pump body is nonelastic such that the air pump is automatically extended by virtue of the air pressure in the inflatable body.

2. An inflatable product as claimed in claim 1, wherein the inflatable body has a plurality of air chambers, and the inflatable product further includes a multi-way valve communicated between the air outlet of the air pump and the plurality of the air chambers.

3. An inflatable product, including:

an inflatable body having air pressure inside; and an air pump built in the inflatable body, the air pump consisting of a pump body, an air inlet provided on the pump body for introducing air outside the inflatable body into the pump body when the pump body is extended, an air outlet also provided on the pump body for introducing the air from the pump body into the inflatable body when the pump body is compressed, and a weight fixed to the pump body, wherein the pump body is nonelastic such that the air pump is automatically extended by virtue of the air pressure in the inflatable body.

4. An inflatable product, including:

an inflatable body having air pressure inside; and an air pump built in the inflatable body, the air pump consisting of a pump body, an air inlet provided on the pump body for introducing air outside the inflatable body into the pump body when the pump body is extended, an air outlet also provided on the pump body for introducing the air from the pump body into the inflatable body when the pump body is compressed, and at least one stiff member fixed to the pump body to prevent the pump body from contracting, wherein the pump body is nonelastic such that the air pump is automatically extended by virtue of the air pressure in the inflatable body.

5. An inflatable product as claimed in claim 4, wherein the stiff member is a ring fixed to the pump body to prevent the pump body from contracting in radial directions of the ring.

6. An Inflatable product as claimed in claim 4, further including a connecting element connected between the pump body and the inflatable body to facilitate an extension of the pump body when the air outside the inflatable body flows into the pump body.

7. An inflatable product as claimed in claim 6, wherein the connecting element is a string.

8. An inflatable product as claimed in claim 6, wherein the connecting element is a band.

9. An inflatable product, including:

an inflatable body having air pressure inside; and an air pump built in the inflatable body, the air pump consisting of a pump body, an air inlet provided on the pump body for introducing air outside the inflatable body into the pump body when the pump body is extended, an air outlet also provided on the pump body for introducing the air from the pump body into the inflatable body when the pump body is compressed, and at least one stiff member fixed to the inflatable body to prevent the pump body from contracting, wherein the pump body is nonelastic such that the air pump is automatically extended by virtue of the air pressure in the inflatable body.

10. An inflatable body as claimed in claim 9, wherein the stiff member is a ring enclosing the pump body to prevent the pump body from contracting in radial directions of the ring.

11. An inflatable product, including:

an inflatable body having air pressure inside; and an air pump built in the inflatable body, the air pump consisting of a pump body, an air inlet provided on the-pump body for Introducing air outside the inflatable body into the pump body when the pump body is extended, an air outlet also provided on the pump body for introducing the air from the pump body into the inflatable body when the pump body is compressed, and a closing device for closing the air inlet, wherein the pump body is nonelastic such that the air pump is automatically extended by virtue of the air pressure in the inflatable body.

12. A method of inflating an inflatable product, including the steps of:

providing an inflatable product of claim 1 and an electric blower;

inflating the inflatable body by the electric blower; and inflating the inflatable body by the air pump.

13. A method of inflating an inflatable product as claimed in claim 12, wherein the electric blower is an electric dryer.

14. A method of inflating an inflatable product, including the steps of:

providing an inflatable product of claim 3 and an electric blower;

inflating the inflatable body by the electric blower; and inflating the inflatable body by the air pump.

15. A method of inflating an inflatable product as claimed in claim 14, wherein the electric blower is an electric dryer.

16. A method of inflating an inflatable product, including the steps of:

providing an inflatable product of claim 4 and an electric blower;

inflating the inflatable body by the electric blower; and inflating the inflatable body by the air pump.

17. A method of inflating an inflatable product as claimed in claim 16, wherein the electric blower is an electric dryer.

18. A method of inflating an inflatable product, including the steps of:

providing an inflatable product of claim 9 and an electric blower;

inflating the inflatable body by the electric blower; and inflating the inflatable body by the air pump.

19. A method of inflating an inflatable product as claimed in claim 18, wherein the electric blower is an electric dryer.

20. A method of inflating an inflatable product, including the steps of:

providing an inflatable product of claim 11 and an electric blower;

inflating the inflatable body by the electric blower; and inflating the inflatable body by the air pump.

21. A method of inflating an inflatable product as claimed in claim 20, wherein the electric blower is an electric dryer.

22. A method of inflating an inflatable product, comprising the steps of:

providing an inflatable body with an air pump built therein, and an electric blower;

inflating the inflatable body by the electric blower; and inflating the inflatable body by the air pump.

23. A method of inflating an inflatable product as claimed in claim 22, wherein the electric blower is an electric dryer.

24. A method of inflating an inflatable product as claimed in claim 22, wherein the air pump built in the inflatable body consists of a pump body, an air inlet provided on the pump body for introducing air outside the inflatable body into the pump body, and an air outlet also provided on the pump body for introducing the air from the pump body into the inflatable body.

25. A method of inflating an inflatable product as claimed in claim 22, wherein the air pump built in the inflatable body consists of a pump body, an air inlet provided on the pump body for introducing air outside the inflatable body into the pump body, an air outlet also provided on the pump body for introducing the air from the pump body into the inflatable body, and a weight fixed to the pump body to facilitate an extension of the pump body when the air outside the inflatable body flows into the pump body.

26. A method of inflating an inflatable product as claimed in claim 22, wherein the air pump built in the inflatable body consists of a pump body, an air inlet provided on the pump body for introducing air outside the inflatable body into the pump body, an air outlet also provided on the pump body for introducing the air from the pump body into the inflatable body, and at feast one stiff member fixed to the pump body to prevent the pump body from contracting.

27. A method of inflating an inflatable product as claimed in claim 22, wherein the air pump built in the inflatable body consists of a pump body, an air inlet provided on the pump body for introducing air outside the inflatable body into the pump body, an air outlet also provided on the pump body for introducing the air from the pump body into the inflatable body, and at least one stiff member fixed to the inflatable body to prevent the-pump body from contracting.

28. A method of inflating an inflatable product as claimed in claim 22, wherein the air pump built in the inflatable body consists of a pump body, an air inlet provided on the pump body for introducing air outside the inflatable body into the pump body, an air outlet also provided on the pump body for introducing the air from the pump body into the inflatable body, and a closing device for closing the air inlet.

* * * * *